US010629420B2

(12) United States Patent
Satoh

(10) Patent No.: US 10,629,420 B2
(45) Date of Patent: Apr. 21, 2020

(54) APPARATUS AND METHOD FOR PROCESSING MASS SPECTRUM

(71) Applicant: JEOL Ltd., Tokyo (JP)

(72) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 16/254,902

(22) Filed: Jan. 23, 2019

(65) Prior Publication Data

US 2019/0228956 A1 Jul. 25, 2019

(30) Foreign Application Priority Data

Jan. 23, 2018 (JP) ..... 2018-008571

(51) Int. Cl.
*H01J 49/00* (2006.01)
*H01J 49/02* (2006.01)

(52) U.S. Cl.
CPC ..... *H01J 49/0036* (2013.01); *H01J 49/0004* (2013.01); *H01J 49/027* (2013.01)

(58) Field of Classification Search
USPC ..... 250/282
See application file for complete search history.

(56) References Cited

U.S. PATENT DOCUMENTS 8,274,045 B2 * 9/2012 Bamberger ..... H01J 49/0004 250/281
8,498,989 B2 * 7/2013 Ikegami ..... H03M 7/3059 341/87
9,412,571 B2 * 8/2016 Ikegami ..... H01J 49/0004
2003/0073145 A1 4/2003 Caprioli
2005/0029444 A1 2/2005 Caprioli
2014/0164444 A1 * 6/2014 Bowen ..... G06F 16/11 707/821
2016/0225595 A1 8/2016 Hizume et al.
2018/0019110 A1 1/2018 Kubo
2018/0197726 A1 * 7/2018 Yamaguchi ..... G01N 27/62

FOREIGN PATENT DOCUMENTS

JP 2005539199 A 12/2005
JP 2016133339 A 7/2016
JP 2017173103 A 9/2017
(Continued)

OTHER PUBLICATIONS

McCombie; et. al., "Spatial and Spectral Correlations in Maldi Mass Spectrometry Images by Clustering and Multivariate Analysis", Anal. Chem., v. 77, No. 19, Oct. 1, 2005, pp. 6118-6124. (Year: 2005).*

(Continued)

*Primary Examiner* — Phillip A Johnston
(74) *Attorney, Agent, or Firm* — The Webb Law Firm

(57) ABSTRACT

An ion intensity array is computed for each mass spectrum forming a mass spectrum array. For each ion intensity array, a plurality of indices a~e showing a plurality of characteristics of the mass spectrum as a whole are computed. Based on the plurality of indices, a plurality of index distribution images are computed. A plurality of index distribution images may alternatively be computed based on a mass image array generated from the mass spectrum array.

11 Claims, 15 Drawing Sheets

(56) References Cited

FOREIGN PATENT DOCUMENTS

| | | | |
|---|---|---|---|
| WO | 03034024 | A2 | 4/2003 |
| WO | 2017002226 | A1 | 5/2017 |

OTHER PUBLICATIONS

Hanton et al., "Investigations of Matrix-Assisted Laser Desorption/Ionization Sample Preparation by Time-of-Flight Secondary Ion Mass Spectrometry", Journal of American Society for Mass Spectrometry, 1999, pp. 104-111, vol. 10.
Paine et al., "Visualizing molecular distributions for biomaterials applications with mass spectrometry imagine: a review", Journal of Materials Chemistry B, 2017, vol. 5.
Satoh, et al., "A mass spectrometry imaging method for visualizing synthetic polymers by using average molecular weight and polydispersity as indices", Presentation, May 2018.
Weidner et al., "Imaging mass spectrometry for examining localization of polymeric composition in matrix-assisted laser desorption/inoization samples", Rapid Communications in Mass Spectrometry, 2009, pp. 653-660, vol. 23.
Stepto et al., "Dispersity in Polymer Science", International Union of Pure and Applied Chemistry, 2009, pp. 351-353, vol. 81, No. 2.
Extended European Search Report issued in EP 19153035.1 dated Jun. 7, 2019.

* cited by examiner

APPARATUS AND METHOD FOR PROCESSING MASS SPECTRUM

CROSS-REFERENCE TO RELATED APPLICATION

This application claims priority to Japanese Patent Application No. 2018-008571 filed Jan. 23, 2018, the disclosure of which is hereby incorporated by reference in its entirety.

BACKGROUND OF THE INVENTION

Field of the Invention

The present disclosure relates to an apparatus and a method for processing a mass spectrum, and in particular to generation of an image based on a plurality of mass spectra.

Description of Related Art

A mass analysis system is generally formed by a mass analysis apparatus and an information processor apparatus. The mass analysis apparatus is an apparatus which measures a mass spectrum, and the information processor apparatus functions as a mass spectrum processing apparatus.

When two-dimensional mass analysis is performed, mass analysis in units of pixels is performed for a plurality of pixels (micro-regions, observation points) of an observation region which is set for a sample. With this process, a plurality of mass spectra (mass spectrum array) corresponding to the plurality of pixels are obtained. Based on the mass spectrum array, an image representing a two-dimensional distribution of substances having a particular mass (more accurately, a particular mass-to-charge ratio (m/z)) is generated (refer to JP 2016-133339 A and JP 2017-173103 A). This image is called a mass image, and the generation of the mass image is called mass imaging. According to the mass image, distribution information of the particular substances, which cannot be obtained from a normal optical image, can be obtained. In general, the mass image is generated while changing the mass to be a target of the imaging. That is, a plurality of mass images (mass image array) are generated.

When a target of the mass analysis is a polymer, normally, a mass spectrum having a general shape of a mountain is obtained, because a plurality of peaks corresponding to a plurality of degrees of polymerization are observed by the mass analysis. For example, when a molecular weight of the polymer is small and mass resolution is large enough, a mass spectrum having a plurality of peaks is obtained. On the other hand, when the molecular weight of the polymer is large and mass resolution is low, a mass spectrum corresponding to or close to a continuous spectrum is obtained. From a plurality of mass spectra corresponding to a plurality of pixels, a mass image showing a two-dimensional distribution of a polymer having a particular degree of polymerization (particular mass) is generated. Alternatively, a plurality of mass images corresponding to a plurality of degrees of polymerization may be generated. JP 2005-539199 A discloses a technique for displaying a distribution of a particular substance.

SUMMARY OF THE INVENTION

The overall distribution of polymers cannot be understood from a single mass image. Even when a plurality of mass images are observed comprehensively, it is still difficult to understand the distribution of polymers as a whole.

An advantage of the present disclosure lies in provision of an image reflecting an entirety of a plurality of mass spectra corresponding to a plurality of pixels. Alternatively, an advantage of the present disclosure lies in provision of an image useful in analysis of polymers.

According to one aspect of the present disclosure, there is provided an apparatus for processing a mass spectrum, comprising: an index computation unit that computes, based on a plurality of mass spectra corresponding to a plurality of pixels which form an observation region which is set for a sample, an index showing a characteristic of a mass spectrum as a whole in units of mass spectra; and a generator that generates an index distribution image corresponding to the observation region based on a plurality of indices corresponding to the plurality of pixels.

According to the above-described structure, an index showing a characteristic of the mass spectrum as a whole is computed in units of mass spectra; that is, in units of pixels. By mapping a plurality of indices corresponding to the plurality of pixels, an index distribution image is generated. Observing the index distribution image enables understanding of the plurality of the mass spectra as a whole. The index may reflect all of the mass spectrum, or may reflect a plurality of portions which discretely exist over the entirety of the mass spectrum. A range to be set as a target of the index computation is, for example, manually designated as a degree-of-polymerization range or a computation range. Alternatively, the range to be the target of index computation may be automatically set as a mass measurement range, a display range, or the like. The index computation unit functions as an index computing means, and the generator functions as a generating means.

According to another aspect of the present disclosure, the sample is a polymer. A mass spectrum of a polymer typically is formed from a plurality of peaks corresponding to a plurality of degrees of polymerization. The index may be computed based on the plurality of peaks or a plurality of portions corresponding to the peaks. The index is, for example, a number average molecular weight, a weight average molecular weight, a polydispersity, a number average degree of polymerization, a weight average degree of polymerization, or a total ion intensity (total ion amount). Alternatively, other indices may be computed. A mixed mass spectrum obtained from a mixed sample (for example, a mixture structure of a plurality of polymers) may be set as a processing target, or a particular mass spectrum included in the mixed mass spectrum may be set as the processing target.

According to another aspect of the present disclosure, the index computation unit computes an index set formed from a plurality of indices showing a plurality of characteristics of the mass spectrum as a whole in units of the mass spectra, and the generator generates a single index distribution image or a plurality of index distribution images based on a plurality of index sets corresponding to the plurality of pixels. Formation of an image indicating the plurality of indices enables more accurate evaluation and analysis of the mass spectrum.

According to another aspect of the present disclosure, the index computation unit computes a plurality of ion intensity arrays from the plurality of mass spectra, and computes the plurality of indices based on the plurality of ion intensity arrays. The ion intensity array is formed from a plurality of ion intensities arranged in a mass axis (m/z axis) direction. The ion intensity may be defined as an area, a height, or the like, of a peaks or a portion corresponding to the peak. Each ion intensity array may be computed from each mass spectrum, or each ion intensity array may be computed from a mass image array.

According to another aspect of the present disclosure, each of the ion intensity arrays is computed based on a plurality of portions which exist discretely on each of the mass spectra. The plurality of portions may be defined by a plurality of sections which are distanced from each other on the mass axis. The individual section is, for example, a peak search section or an ion intensity summing section. According to another aspect of the present disclosure, the sample is a polymer, and the plurality of portions correspond to a plurality of degrees of polymerization of the polymer. Defining the plurality of portions corresponding to the plurality of degrees of polymerization enables correct extraction of the mass spectrum of the measurement target polymer while excluding unnecessary signals.

According to another aspect of the present disclosure, each of the ion intensity arrays is computed based on a plurality of portions which exist on each of the mass spectra in an interconnected manner. For example, the mass spectrum is divided in units of a certain width, and the plurality of portions are set in this manner.

According to another aspect of the present disclosure, a plurality of mass images are generated based on the plurality of mass spectra, and the index computation unit computes the plurality of indices corresponding to the plurality of pixels based on the plurality of mass images. In this manner, it is also possible to compute the plurality of indices from the plurality of mass images.

According to another aspect of the present disclosure, there is provided a method for processing a mass image, comprising: computing, based on a plurality of mass spectra corresponding to a plurality of pixels which are set for a sample, an index set formed from a plurality of indices and showing a plurality of characteristics of a mass spectrum as a whole in units of mass spectra; and generating a plurality of index distribution images based on a plurality of the index sets corresponding to the plurality of pixels. Here, each index distribution image is a one-dimensional distribution image or a two-dimensional distribution image.

BRIEF DESCRIPTION OF THE DRAWINGS

Embodiment(s) of the present disclosure will be described by reference to the following figures, wherein.

DESCRIPTION OF THE INVENTION

Embodiments of the present disclosure will now be described with reference to the drawings.

Figure 1:
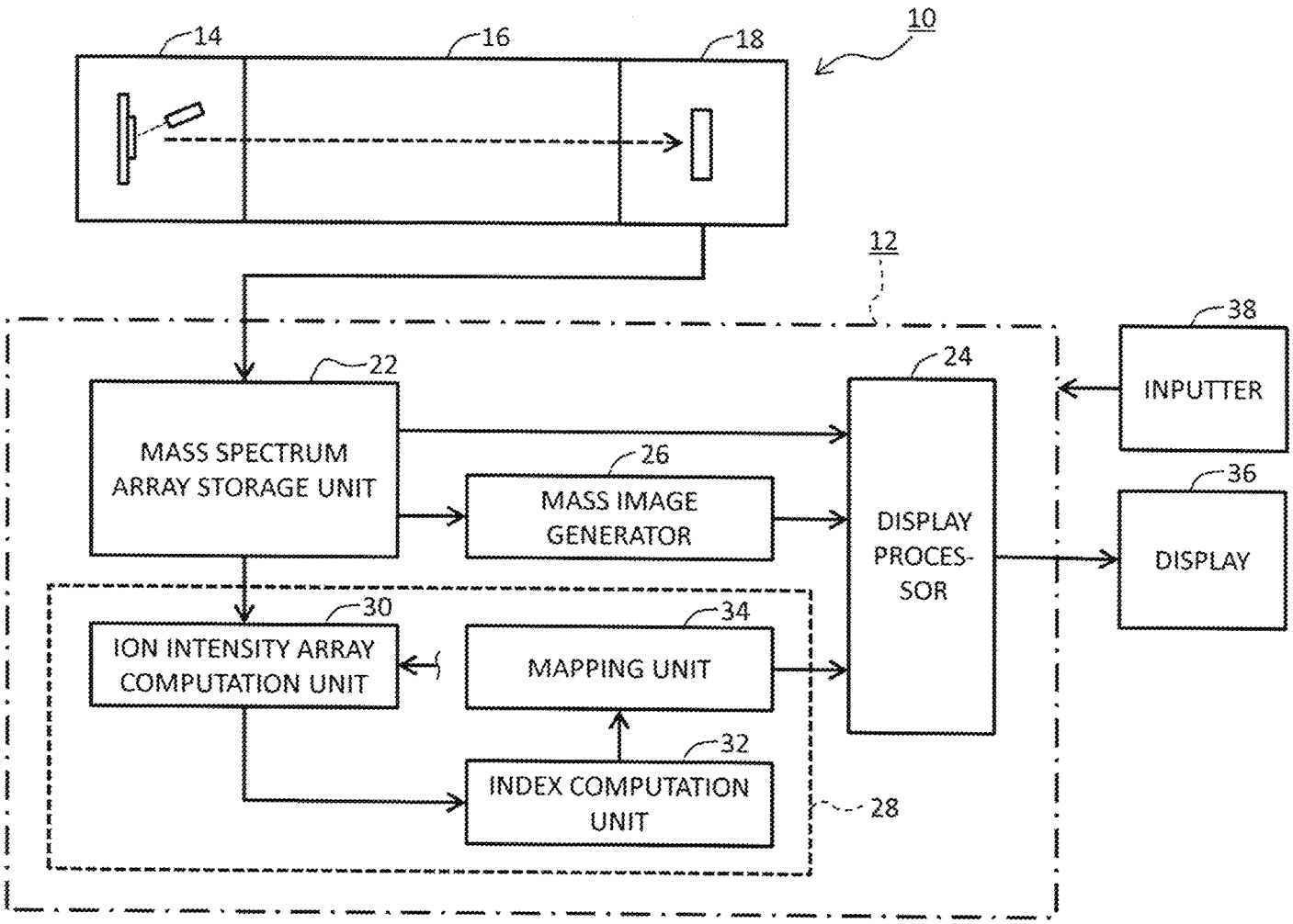
FIG. 1 is a diagram showing a mass analysis system according to a first embodiment of the present disclosure.

FIG. 1 shows a mass analysis system according to a first embodiment of the present disclosure. The mass analysis system has a mass imaging function. The mass analysis system is generally formed from a mass analysis apparatus 10 and an information processor apparatus 12. The information processor apparatus 12 functions as an apparatus for processing mass spectrum. As will be described later, in the information processor apparatus 12, a mass image is generated, and an index distribution image is generated. In the embodiment, a sample to be a target of analysis is a synthesized polymer or a natural polymer. Alternatively, other samples may be set as an analysis target.

The mass analysis apparatus 10 shown in FIG. 1 is an apparatus that performs mass analysis on a plurality of pixels forming an observation region which is set for the sample. The observation region is set on the sample, or is set to include the sample. An individual pixel is a micro-region, and corresponds to an observation point. The observation region is, for example, a quadrangular, two-dimensional region, and a number of pixels in an x direction and a number of pixels in a y direction are, for example, each a few tens or a few hundreds. One pixel has, for example, a size of 100 μm×100 μm. A user (a person performing the measurement) designates the observation region, a number of divisions of the observation region (pixel size), a number of irradiations of laser in units of pixels (for example, a few tens of times or a few hundreds of times), or the like. The mass analysis apparatus 10 operates according to the designated information. The numerical values described herein are merely exemplary.

In the exemplified example structure, the mass analysis apparatus 10 comprises an ion source 14, a mass analyzer 16, and a detector unit 18. These elements are devices including electronic components and mechanical components.

The ion source 14 is, for example, an ion source according to a matrix assisted laser desorption/ionization (MALDI) method. According to MALDI, univalent ions are mainly generated. Therefore, MALDI is used in many occasions in analysis of polymers. More specifically, a sample is placed on a sample plate, and a laser is radiated onto the sample. A laser irradiation point corresponds to a pixel. Ions discharged from the laser irradiation point are guided to the inside of the mass analyzer 16 by an action of an electric field. By two-dimensional scanning of the sample plate, the laser irradiation points on the sample are two-dimensionally scanned. Alternatively, the laser irradiation points may be moved. Alternatively, an ion source according to secondary ion mass spectrometry (SIMS) method may be used in which primary ions are radiated onto the sample, and secondary ions which are generated as a result are measured. Alternatively, other ion sources may be used.

The mass analyzer 16 is a unit which performs mass separation according to the mass of the ion (more accurately, the mass-to-charge ratio m/z). For example, a time-of-flight type mass analyzer is used. Alternatively, a mass analyzer of another type may be used. The detector unit 18 has a detector which detects ions. An output signal of the detector unit 18 corresponds to a mass spectrum. For each laser irradiation operation in units of pixels, a plurality of ion intensities (ion intensity array) corresponding to a plurality of m/z's are obtained. A plurality of mass spectra obtained by a plurality of laser irradiations in units of pixels are accumulated, to generate an accumulated mass spectrum. The accumulated mass spectrum is a unit of processing in the information processor apparatus 12 to be described below. Alternatively, the accumulation process may be performed in the information processor apparatus 12.

The information processor apparatus 12 functions as the apparatus for processing mass spectrum as described above, and is formed from, for example, a personal computer (PC). The information processor apparatus 12 has a CPU and a storage unit. An operation program stored in the storage unit is executed by the CPU, and the plurality of functions to be described below are thus realized. In FIG. 1, these functions are expressed as a plurality of blocks. The information processor apparatus 12 may be formed as an apparatus having a plurality of processors, or may be formed from a plurality of information processing devices. A program for the mass spectrum processing may be installed into the information processor apparatus 12 via a transportable recording medium or via a network. Individual data processed by the information processor apparatus 12 are ion intensity data specified by an x coordinate, a y coordinate, and the m/z.

A mass spectrum array storage unit 22 is formed from a hard disk drive or a semiconductor memory. The mass spectrum array storage unit 22 stores a plurality of mass spectra corresponding to a plurality of pixels; that is, a mass spectrum array. The substance of individual mass spectrum is the ion intensity distribution on the m/z axis.

A mass image generator 26 is a module which generates a mass image serving as a two-dimensional mass distribution. A plurality of the mass images may be generated in units of channels on the m/z axis, or a plurality of the mass images corresponding to a plurality of selected m/z's (or m/z sections) may be generated.

Data indicating the generated mass image are sent via a display processor 24 to a display 36. On a screen of the display 36, one or a plurality of mass images are displayed. Normally, the mass image is displayed as a color image. The ion intensity corresponding to individual pixel is expressed by a brightness or a color phase. One or a plurality of mass spectra are displayed on the screen of the display 36 as necessary. The display 36 is formed from an LCD, an organic EL display device, or the like. Alternatively, the image data may be transferred to an external device via a network. Alternatively, the mass image generation and display may be performed in parallel with the mass analysis.

The information processor apparatus 12 according to the first embodiment comprises an index distribution image generator 28. The index distribution image generator 28 has an ion intensity array computation unit 30 which functions as an ion intensity array computing means, an index computation unit 32 which functions as an index computing means, and a mapping unit 34 which functions as a generating means. Alternatively, the index computation unit 32 may function as both the ion intensity array computing means and the index computing means.

The ion intensity array computation unit 30 performs mass spectrum analysis in units of pixels; that is, in units of mass spectra, to determine the ion intensity array. The ion intensity array is formed from a plurality of ion intensities determined from a plurality of portions included in the mass spectrum. As will be described in detail later, the plurality of portions are a plurality of peak waveforms corresponding to a plurality of degrees of polymerization (a plurality of degrees of polymerization of analysis target polymers), a plurality of band portions corresponding to a plurality of sections corresponding to the plurality of degrees of polymerization, or a plurality of divided portions corresponding to a plurality of divided sections. The plurality of peaks and the plurality of band portions exist discretely on the mass axis. The plurality of divided sections exist on the mass axis in an interconnected manner. The ion intensity typically corresponds to an area of the peaks (for example, an area in a full width half maximum), an area of the band portion, or an area of the divided portion. Alternatively, the ion intensity may be specified from a peak level in the portion or the like. A plurality of ion intensities extracted from the mass spectrum as a whole show a characteristic (for example, a characteristic in the form, a characteristic in position, or the like) of the mass spectrum as a whole.

The index computation unit 32 computes the index based on the ion intensity array for each pixel; that is, for each mass spectrum. The index is, for example, a number average molecular weight Mn, a weight average molecular weight Mw, a polydispersity PD, a number average degree of polymerization Dpn, a weight average degree of polymerization Dpw, or the like. These indices all show properties of polymers. These indices are defined as follows. Here, Mn represents a mass of polymer ion specified by a degree of polymerization i, and ni represents an ion amount of a polymer ion specified by the degree of polymerization i. In addition, R represents a mass of a repetition unit (monomers).

[Equation 1]

$$Mn=\Sigma(Mi*ni)/\Sigma ni \quad (1)$$

$$Mw=\Sigma(Mi^2*ni)/\Sigma(Mi*ni) \quad (2)$$

$$PD=Mw/Mn \quad (3)$$

$$DPn=Mn/R \quad (4)$$

$$DPw=Mw/R \quad (5)$$

A maximum value and a minimum value of a range of the degree of polymerization i are designated by the user or are set in advance. As an index other than the indices describe above, a total ion amount Itotal may be exemplified, which corresponds to an area of the overall spectrum. Alternatively, other indices may be computed.

In the embodiment, for each mass spectrum, a plurality of indices (an index set) are computed based on the ion intensity array. For example, four indices including the number average molecular weight Mn, the weight average molecular weight Mw, the polydispersity PD, and the total ion amount Itotal are computed.

An individual index shows a characteristic of the mass spectrum as a whole. That is, an individual index is information reflecting the mass spectrum as a whole. In this sense, the individual index differs from a simple maximum value in the spectrum, a simple accumulation value of a particular portion in the spectrum, or the like.

The mapping unit 34 is a module which maps a plurality of the index sets computed for a plurality of pixels, to generate a plurality of index distribution images. A magnitude of the individual index is expressed as a change of a color phase or a change of brightness. Each index distribution image is a two-dimensional distribution image. Alternatively, as will be described later, a one-dimensional distribution image may be generated. Alternatively, the plurality of indices may be expressed as color phase changes or brightness changes which differ from each other. Data showing each index distribution image are sent via the display processor 24 to the display 36, and, in the present embodiment, a plurality of the index distribution images are simultaneously or sequentially displayed on the screen of the display 36. Alternatively, a color process or a brightness process with respect to each index distribution image may be performed at the display processor 24. Alternatively, an index distribution image simultaneously expressing a plurality of indices may be generated and displayed. Alternatively, a single index distribution image generated by synthesis of a plurality of index distribution images may be displayed.

An inputter 38 is formed from a keyboard, a pointing device, or the like. Using the inputter 38, the user can determine the observation region, pixel conditions, measurement conditions such as the irradiation number, or the like. Further, one or a plurality of the indices to be mapped are designated. Moreover, as will be described in detail later, information necessary for mass spectrum analysis, for example, information (such as a composition or a mass of a repetition unit, a composition or a mass of a terminal group, a composition or a mass of a cationizing agent, a range of the degree of polymerization, or the like) for specifying a polymer series (an array made of a plurality of same polymers having different degrees of polymerization) is designated. Alternatively, other information may be designated in addition to these types of information, or other information may be designated in place of these types of information.

A mass spectrum of a polymer typically is formed from a plurality of peaks arranged discretely in the order of the degree of polymerization. A spacing between adjacent peaks (peak spacing) corresponds to a mass of the monomer. Individual mass where the peak waveform occurs can be computed by (mass of monomer)×(degree of polymerization)+(mass of terminal group)+(mass of cationizing agent). In other words, the individual mass which is observed can be theoretically specified if these parameters are known. Based on such a series of mass theoretical values, peak judgment or peak search may be performed. When the mass spectrum of the polymer is a continuous spectrum or when an unknown polymer is set as the measurement target, methods other than the theoretical estimation described above may be employed. This will be described in detail later.

According to the above-described embodiment, for each pixel, an index showing a characteristic of the mass spectrum as a whole, obtained from the pixel, can be computed, and an index distribution image can be generated from a plurality of indices computed for a plurality of pixels. Through observation of the index distribution image, it becomes possible to understand a tendency of the individual mass spectrum, as well as a spatial change of the mass spectrum. Further, in the above-described embodiment, because a plurality of types of the index distribution images are displayed, each mass spectrum can be evaluated from multiple aspects through observation of the index distribution images.

Figure 2:
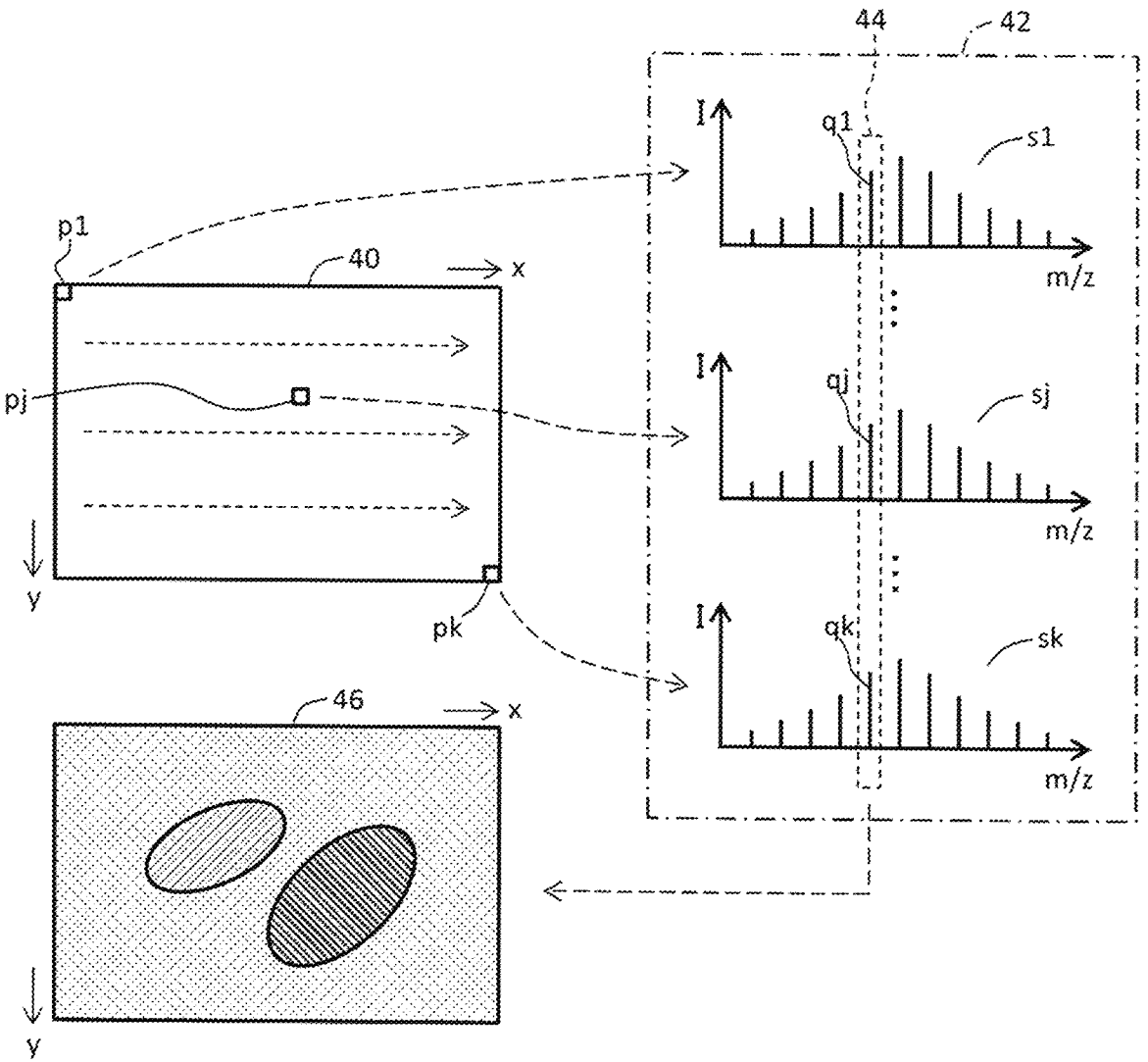
FIG. 2 is a diagram showing generation of a mass image based on a mass spectrum array.

FIG. 2 shows a method of generating a mass image performed by the mass image generator described above. An observation region 40 is formed from a plurality of pixels arranged in the x direction and the y direction. In other words, the observation region 40 is formed from a first pixel to a kth pixel. As described above, each pixel corresponds to the laser irradiation point; that is, the observation point. In FIG. 2, a first pixel p1, a jth pixel pj, and a last pixel pk are explicitly shown. A mass spectrum array 42 is formed by a plurality of mass spectra obtained from the plurality of the pixels. The mass spectrum array 42 includes a first mass spectrum s1, a jth mass spectrum sj, and a last mass spectrum sk. In the example exemplified in the drawings, each individual mass spectrum includes a plurality of peak waveforms arranged discretely on the m/z axis.

In the mass spectrum 42, as shown by reference numeral 44, a plurality of ion intensities for a plurality of peak waveforms (for example, refer to q1, qj, and qk) corresponding to a selected degree of polymerization (that is, mass) are referred to. For example, the ion intensity is specified as an area in an individual peak. By mapping a plurality of ion intensities corresponding to the plurality of pixels, a mass image 46 corresponding to the selected degree of polymerization is generated. The magnitude of individual ion intensity is expressed as the brightness change or the color phase change. By repeating these processes, a plurality of mass images corresponding to a plurality of degrees of polymerization are generated. The plurality of mass images form a mass image array.

Figure 3:
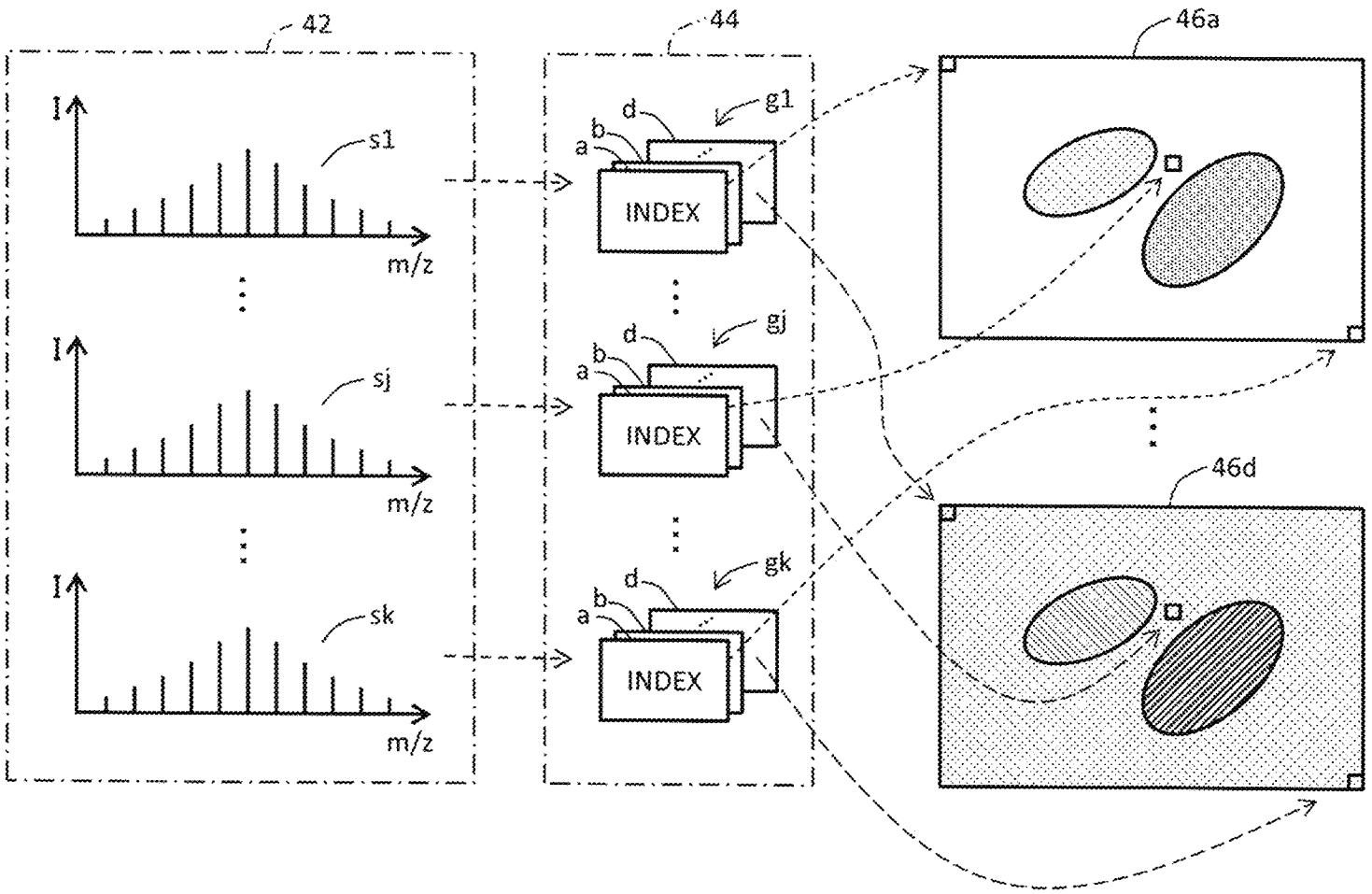
FIG. 3 is a diagram showing generation of a plurality of index distribution images based on a mass spectrum array.

FIG. 3 shows a method of generating an index distribution image performed by the index distribution image generator. Based on the mass spectrum array 42, an index set array 44 is computed. In FIG. 3, a first index set g1, a jth index set gj, and a last index set gk are explicitly shown. Specifically, for each mass spectrum, the ion intensity array is specified based on the mass spectrum, and an index set is computed through a plurality of index computation equations based on the ion intensity array. Each individual index set is formed from, for example, 4 indices from an index a to an index d. For example, the index a to the index d are the number average molecular weight, the weight average molecular weight, the polydispersity, and the total ion amount. By a mapping based on the index set array 44, index distribution images 46*a*~46*d* corresponding to the indices a~d are generated. By referring to a plurality of index distribution images, it becomes possible to evaluate a spatial change of the mass spectrum from a plurality of viewpoints.

Figure 4:
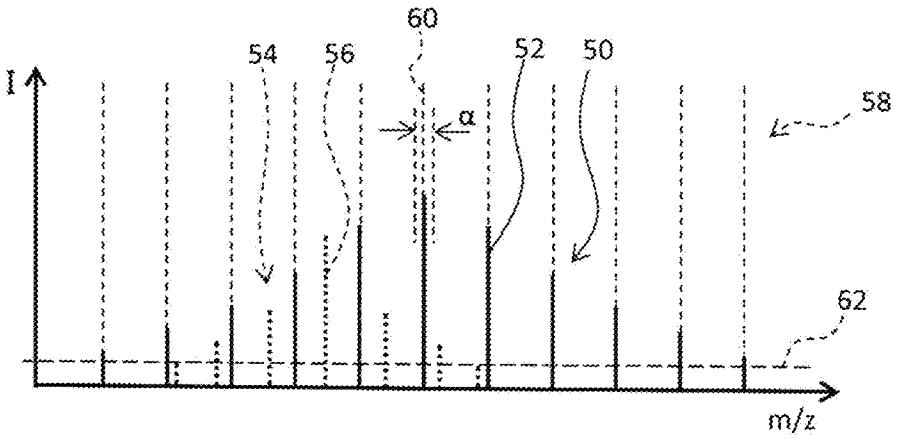
FIG. 4 is a diagram showing an example of mass spectrum analysis.

FIG. 4 shows an example of a method of analyzing a mass spectrum. An analysis target polymer 50 is formed from a plurality of peaks 52 corresponding to a plurality of degrees of polymerization. For example, when the molecular weight of the polymer is smaller than 10,000, such a discrete spectrum tends to be obtained. In the example shown in FIG. 4, a polymer 54 which is not an analysis target is also observed along with the mass spectrum 50. The polymer 54 is also formed from a plurality of peaks 56 corresponding to a plurality of degrees of polymerization. In order to identify the analysis target polymer 50, the mass spectrum is analyzed.

Figure 5:
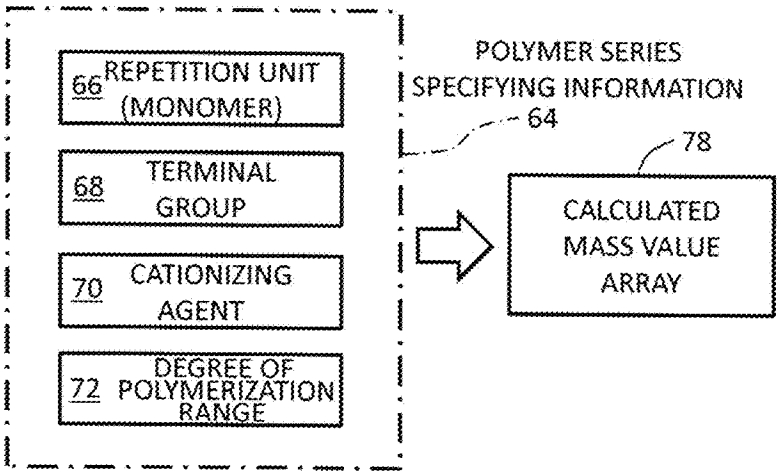
FIG. 5 is a diagram for explaining computation of a mass theoretical value array.

During this process, as shown in FIG. 5, for the analysis target polymer, based on polymer series specifying information 64, a plurality of calculated mass values 78 (a calculated mass value array) corresponding to the plurality of degrees of polymerization of the polymer are computed. Here, for example, the mass theoretical value array 78 is computed based on a mass 66 of the repetition unit (monomer), a mass 68 of a terminal group, a mass 70 of a cationizing agent, and a range 72 of the degree of polymerization.

Referring back to FIG. 4, based on the calculated mass value array, identification of a plurality of peaks corresponding to the analysis target polymer is enabled. More specifically, on the m/z axis, a maximum peak is searched in a nearby range a of each calculated mass value 60, to identify the peak which is a target of the ion intensity computation. Alternatively, all of a plurality of peaks belonging to the nearby range a of each calculated mass value 60 may be identified as the ion intensity computation target. Alternatively, the ion intensity may be computed by performing an accumulation process in the nearby region a of each calculated mass value 60. In any case, with the above-described process, a plurality of portions which exist discretely over the entirety of the mass spectrum can be specified, and the ion intensity can be specified for each individual portion. The plurality of portions may alternatively be described as a plurality of representative portions extracted from the entirety of the mass spectrum.

Alternatively, a threshold 62 may be set on the ion intensity axis, and only peaks that exceed the threshold 62 may be set as the processing target. In the example of FIG. 4, the polymer 50 is identified, but alternatively, both the polymer 50 and 54 may be identified.

Figure 6:
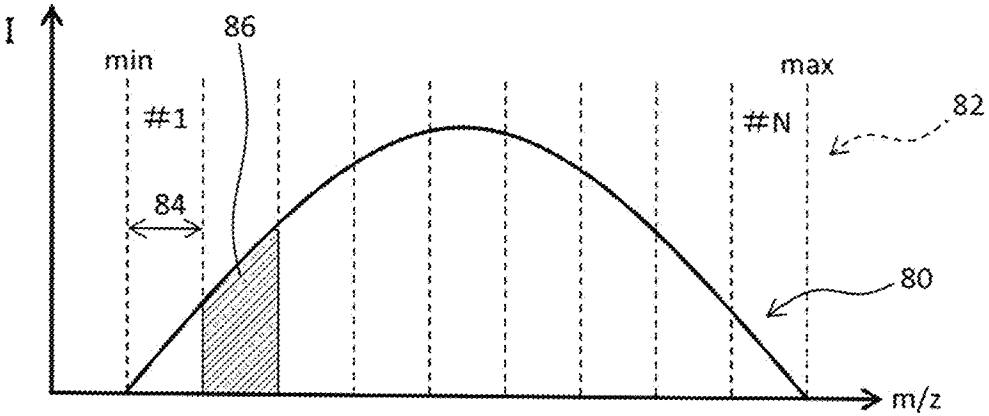
FIG. 6 is a diagram showing another example of the mass spectrum analysis.

FIG. 6 shows another example of a method of analyzing a mass spectrum. A polymer peak 80 is a continuous spectrum. For example, when a molecular weight of an analysis target polymer exceeds 10,000, such a continuous polymer peak tends to be obtained due to the low mass resolution. The following process may be applied when the continuous polymer peak is obtained or when the measurement target is an unknown monomer.

A minimum value min and a maximum value max of a dividing process range for the polymer peak 80 are designated by the user. In addition, a number of divisions N or a division section length 84 is designated by the user. Under the designated conditions, the polymer peak 80 is divided into a plurality of divided sections #1~#N. These sections are interconnected on the m/z axis. For each of the individual divided sections #1~#N, an area 86 is computed. The area 86 corresponds to the ion intensity. In the example configuration of FIG. 6 also, a plurality of portions are specified over the entirety of the mass spectrum, and the ion intensity is computed for each individual portion.

Figure 7:
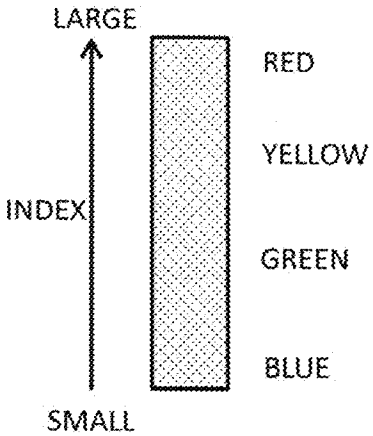
FIG. 7 is a diagram showing an example of a coloring method.

FIG. 7 shows an example of a coloring method for the index distribution image. As shown in FIG. 7, the magnitude of the index may be expressed by a change of a color phase. In the example configuration shown in the figure, blue is assigned for a minimum index, and red is assigned for a maximum index. The color phase change is exemplary. Alternatively, a plurality of types of color phase changes may be assigned for a plurality of types of indices.

Figure 8:
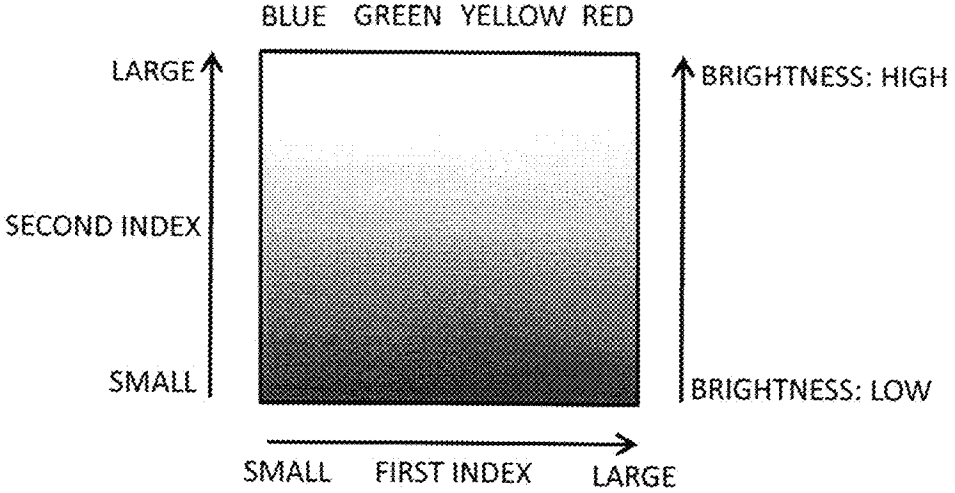
FIG. 8 is a diagram showing another example of the coloring method.

FIG. 8 shows another example of a coloring method for the index distribution image. In the example configuration of FIG. 8, one index distribution image is generated based on two indices. Specifically, a first index is expressed by the color phase change, and a second index is expressed by a brightness change. In other words, a combination of the first index and the second index can be specified by a combination of the color phase and the brightness. Alternatively, a plurality of index distribution images may be generated and then combined. For example, a three-dimensional representation may be employed.

Figure 9:
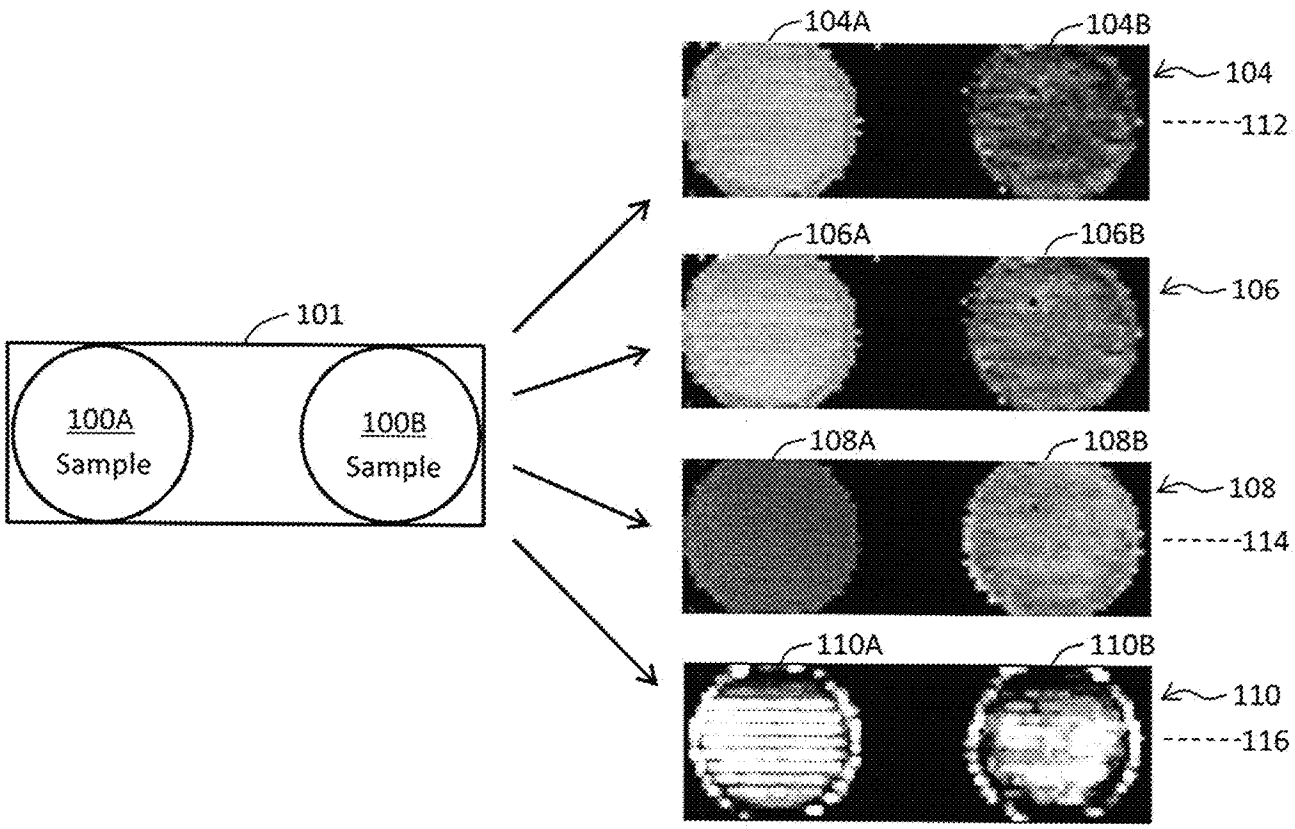
FIG. 9 is a diagram showing a plurality of index distribution images.
Figure 10:
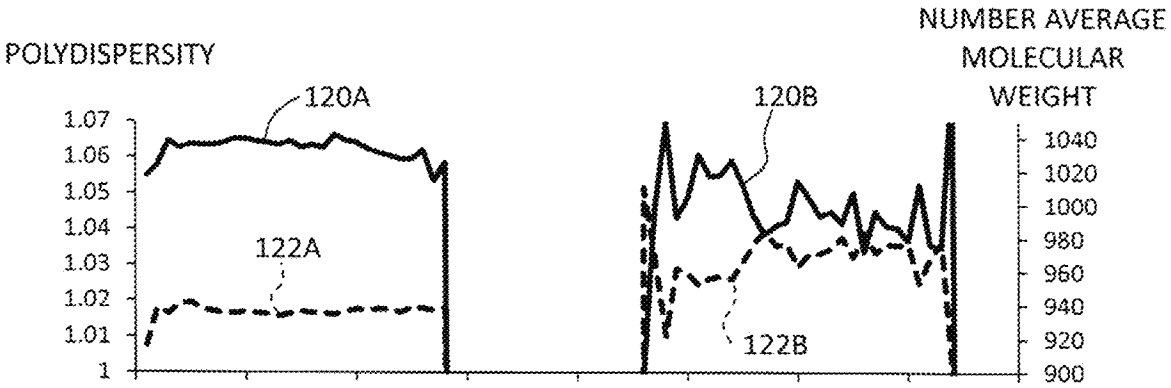
FIG. 10 is a diagram showing a change of a number average molecular weight and a change of a polydispersity.
Figure 11:
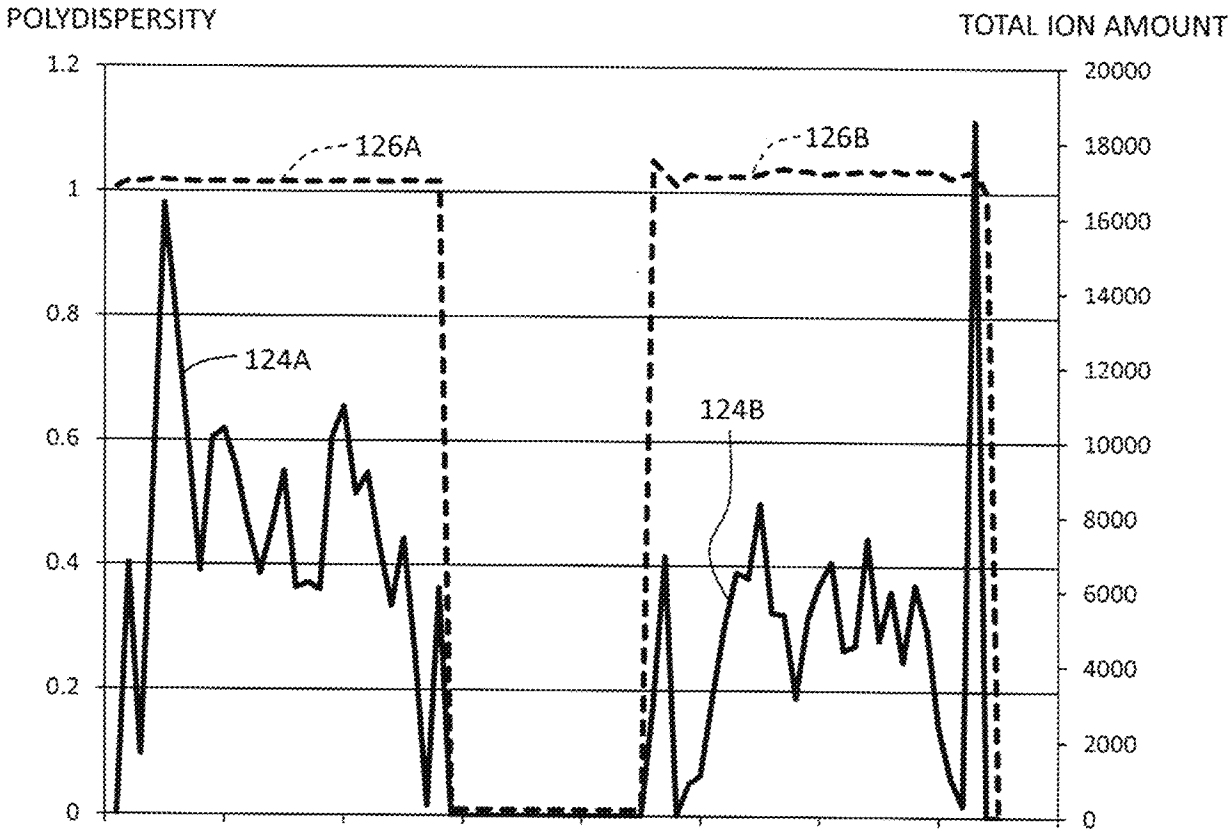
FIG. 11 is a diagram showing a change of a total ion intensity and a change of polydispersity.

With reference to FIGS. 9~11, a specific example of the index distribution image will be described. FIG. 9 shows on a left side a carrier 101. On the carrier 101, a circular first sample 100A and a circular second sample 100B are provided. The first sample 100A is a first polymer. The second sample 100B is a mixture of the first polymer and a second polymer.

FIG. 9 shows on a right side a number average molecular weight distribution image set 104, a weight average molecular weight distribution image set 106, a polydispersity distribution image set 108, and a total ion amount distribution image set 110. For example, four preceding images are two-dimensional color images, and the last image is a two-dimensional black-and-white image. The number average molecular weight distribution image set 104 includes a number average molecular weight distribution image 104A for the first sample 100A and a number average molecular weight distribution image 104B for the second sample 100B. The weight average molecular weight distribution image set 106 includes a weight average molecular weight distribution image 106A for the first sample 100A, and a weight average molecular weight distribution image 106B for the second sample 100B. The polydispersity distribution image set 108 includes a polydispersity distribution image 108A for the first sample 100A and a polydispersity distribution image 108B for the second sample 100B. The total ion amount distribution image set 110 includes a total ion amount distribution image 110A for the first sample 100A and a total ion amount distribution image 110B for the second sample 100B.

FIG. 10 compares and shows a one-dimensional change of the number average molecular weight at a position 112 of FIG. 9 and a one-dimensional change of the polydispersity at a position 114 of FIG. 9. FIG. 10 corresponds to an enlarged view. The one-dimensional change of the number average molecular weight specifically includes a number average molecular weight distribution 120A for the first sample, and a number average molecular weight distribution 120B for the second sample. The one-dimensional change of the polydispersity includes a polydispersity distribution 122A for the first sample, and a polydispersity distribution 122B for the second sample.

FIG. 11 compares and shows a one-dimensional change of the total ion amount at a position 116 of FIG. 9, and a one-dimensional change of the polydispersity at the position 114 of FIG. 9. The one-dimensional change of the total ion amount includes a total ion amount distribution 124A for the first sample, and a total ion amount distribution 124B for the second sample. Similar to that shown in FIG. 10, the one-dimensional change of the polydispersity includes a polydispersity distribution 126A for the first sample and a polydispersity distribution 126B for the second sample.

By simultaneously displaying a plurality of index distribution images in a manner described above, it becomes easier to evaluate an individual sample spatially and from multiple aspects.

Next, with reference to FIGS. 12~14, first through third examples of a method of processing a spectrum performed by the information processor apparatus will be described, also for the purpose of summarizing the above description.

Figure 12:
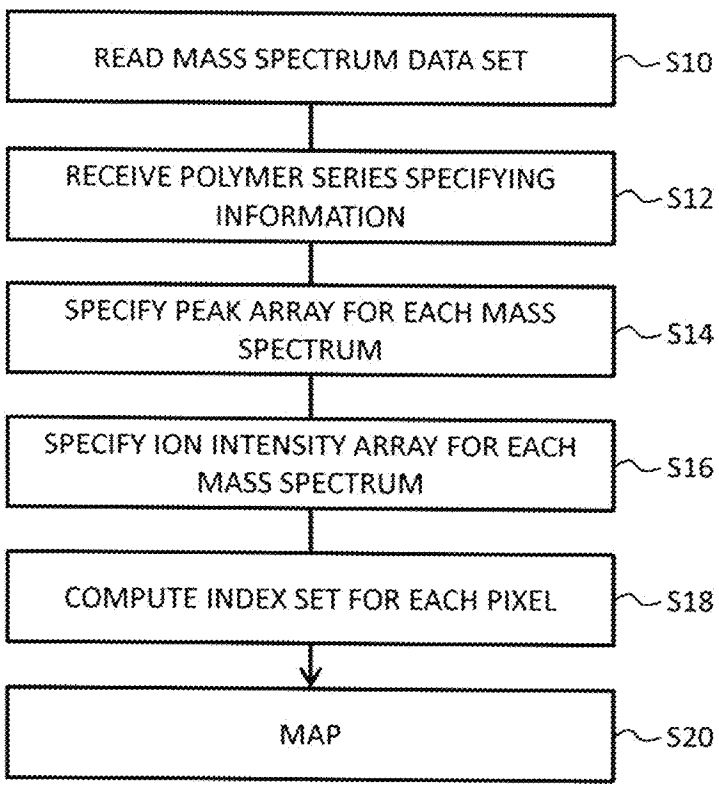
FIG. 12 is a diagram showing a first example of a method of processing a mass spectrum.

In the first example shown in FIG. 12, in S10, a mass spectrum data set is read from the mass analysis apparatus. The data set is stored on the storage unit. In S12, polymer series specifying information which is input by the user is received. In S14, based on a mass theoretical value array computed based on the polymer series specifying information, a plurality of peaks corresponding to the sample are specified. This process is performed in units of mass spectra. In S16, for each mass spectrum, a plurality of ion intensities are specified from the plurality of peaks. In S18, for each mass spectrum; that is, for each pixel, an index set is computed from the plurality of ion intensities. In S20, by a mapping of the individual index, a plurality of index distribution images are generated.

Figure 13:
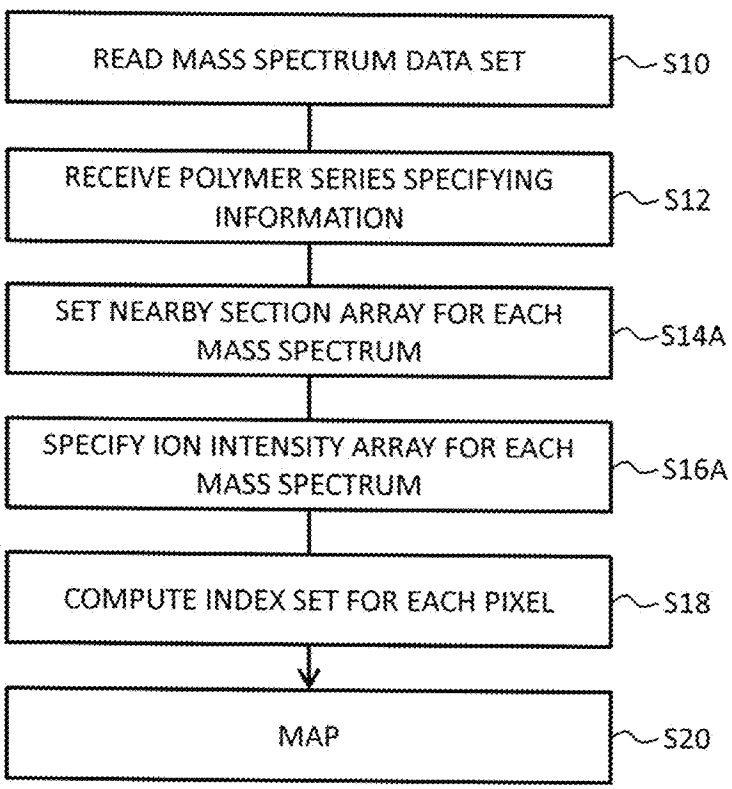
FIG. 13 is a diagram showing a second example of a method of processing a mass spectrum.

FIG. 13 shows a second example of the method of processing the spectrum. Steps similar to the steps shown in FIG. 12 are assigned the same reference numerals, and will not be described again. This is also true for the third example shown in FIG. 14, and fourth through sixth examples shown in FIGS. 17~19, which will be described later.

In S14A, a nearby section array is set based on the mass theoretical value array computed based on the polymer series specifying information. For example, there is set a nearby section which is centered at an individual calculated mass value and which has a certain width. In S16A, the ion intensity is computed as an area of one or a plurality of peaks belonging to individual nearby section, or as a total area in the individual nearby section.

Figure 14:
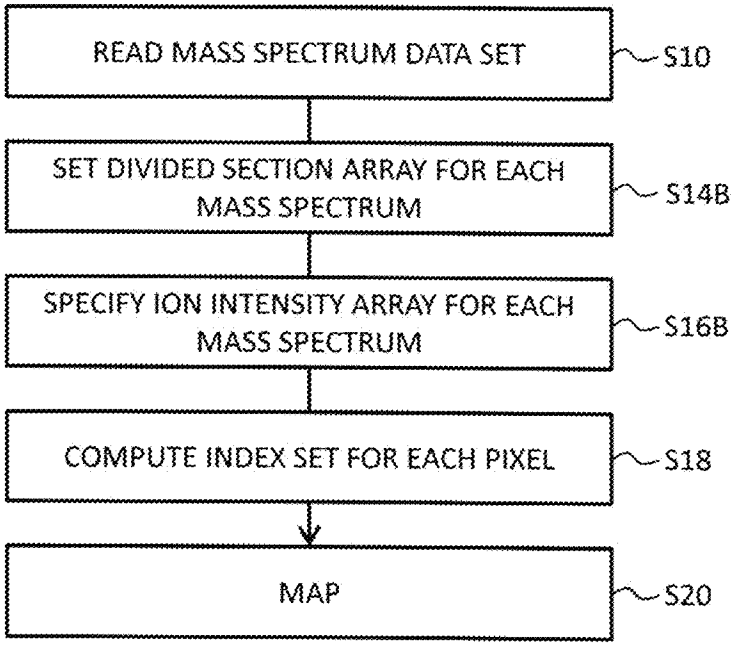
FIG. 14 is a diagram showing a third example of a method of processing a mass spectrum.

FIG. 14 shows the third example of the method of processing the spectrum. In S14B, a plurality of divided sections are set for the mass spectrum; that is, the mass spectrum is divided into a plurality of portions. In S16B, an area of the individual divided section is computed. In this manner, a plurality of ion intensities corresponding to the plurality of divided sections are identified.

Figure 15:
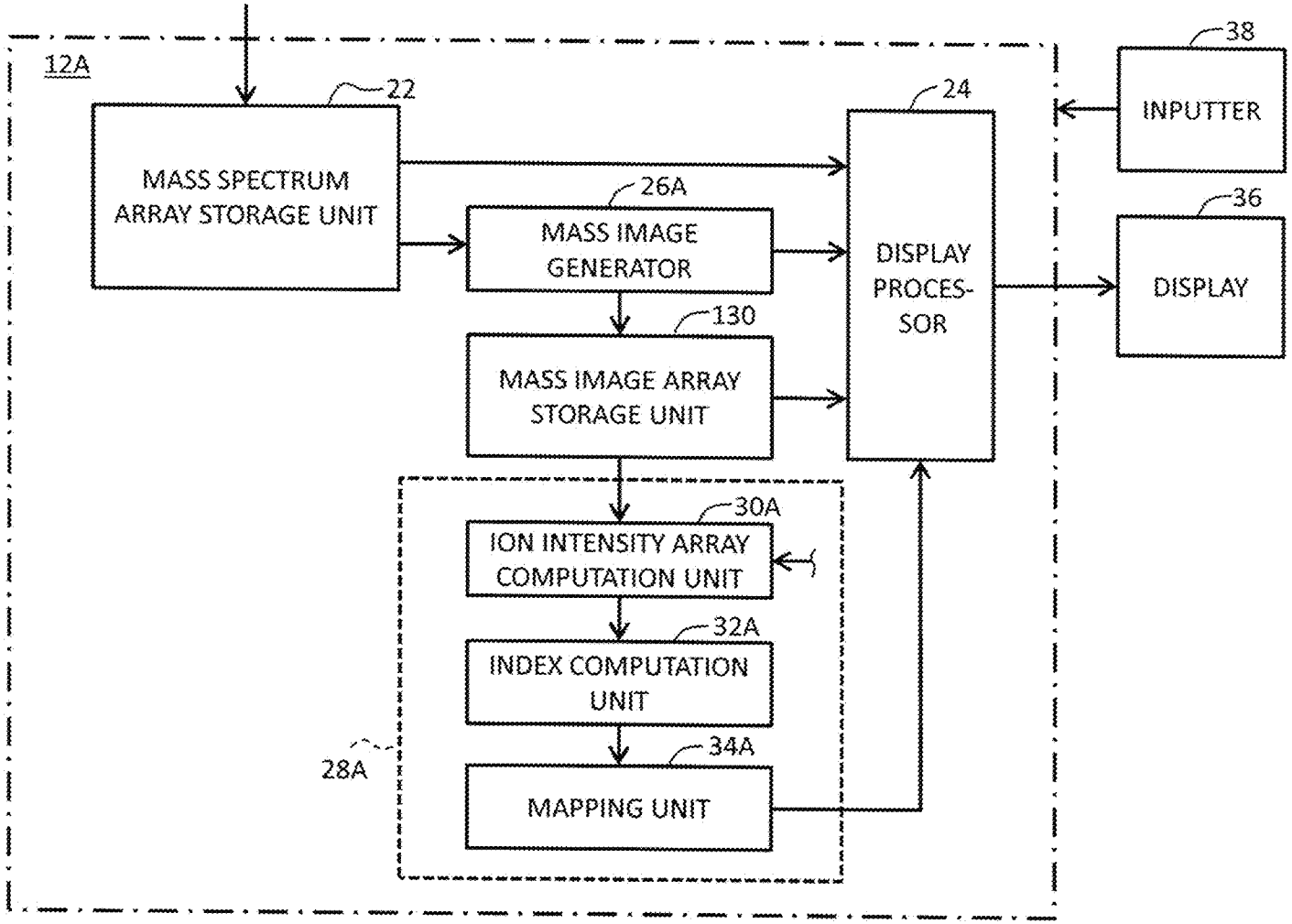
FIG. 15 is a diagram showing an information processor apparatus according to a second embodiment of the present disclosure.

FIG. 15 shows an information processor apparatus according to a second embodiment of the present disclosure. Structures similar to the structures shown in FIG. 1 are assigned the same reference numerals, and will not be described again.

In the second embodiment, in a mass image generator 26A, a plurality of mass images corresponding to a plurality of masses are generated based on the mass spectrum array. The plurality of mass images form a mass image array, and are stored in a mass image array storage unit 130. The mass image array storage unit 130 is formed from a hard disk drive, a semiconductor memory, or the like.

An index distribution image generator 28A includes an ion intensity array computation unit 30A which functions as an ion intensity array computing means, an index computation unit 32A which functions as an index computing means, and a mapping unit 34A which functions as a generating means. Alternatively, the index computation unit 32A may function as both the ion intensity array computing means and the index computing means.

The ion intensity array computation unit 30A extracts a plurality of mass images from the mass image arrays based on the calculated mass image array, and computes an ion intensity array corresponding to the individual pixel based on the plurality of mass images. As a method of extracting the mass image, various methods may be considered. For example, a mass image corresponding to individual mass theoretical value may be extracted. Alternatively, a nearby section may be set with reference to an individual mass theoretical value, and a plurality of mass images belonging to the nearby section may be extracted. In this case, a plurality of ion intensities belonging to the nearby section may be evaluated in units of pixels and an ion intensity corresponding to the sample may be specified from the plurality of ion intensities, or all of the plurality of ion intensities belonging to the nearby section may be set as an ion intensity computation target. Alternatively, a plurality of divided sections may be set on the mass axis for the mass image array, and a plurality of ion intensities may be accumulated in units of pixels for each divided section.

The index computation unit 32A computes an index set based on the ion intensity array computed for individual pixel. The mapping unit 34A maps the plurality of indices of individual index set, to generate a plurality of index distribution images. In this manner, because the individual mass image is a two-dimensional distribution of the ion intensity, the ion intensity array can be specified and the index may be computed after the mass image array is formed.

Figure 16:
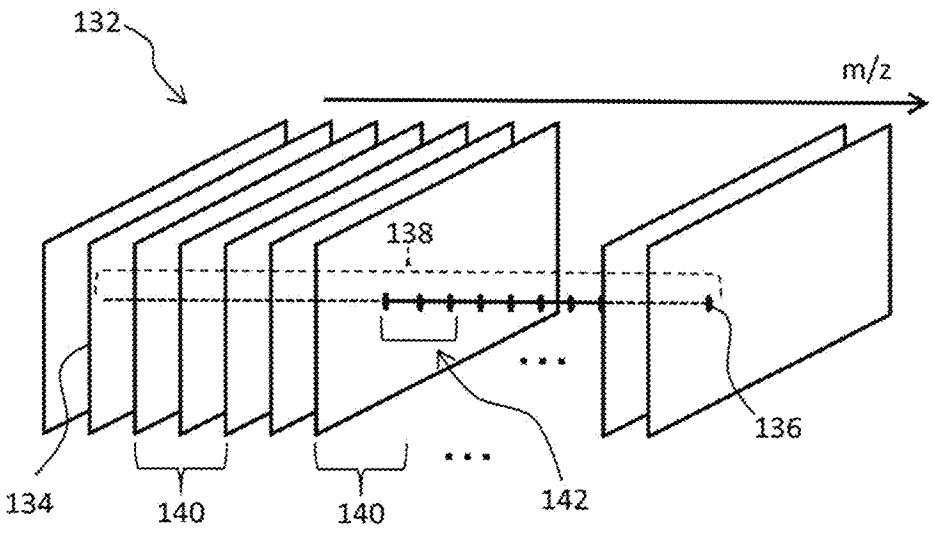
FIG. 16 is a diagram for explaining an index computation based on a mass image array.

FIG. 16 shows a processing of the mass image array according to the second embodiment of the present disclosure. The mass image array 132 is formed from a plurality of mass images 134 arranged in a mass axis direction. For example, for a certain pixel, an ion intensity array 138 arranged in the mass axis direction exists for the pixel, which includes a plurality of ion intensities 136. For example, when a section 140 is set as a nearby section or a divided section, a plurality of ion intensities 142 belonging to the section 140 are referred to, and one or a plurality of ion intensities to be used for the index computation is selected from among these ion intensities 142, or all of the ion intensities 142 are used in the index computation.

Figure 18:
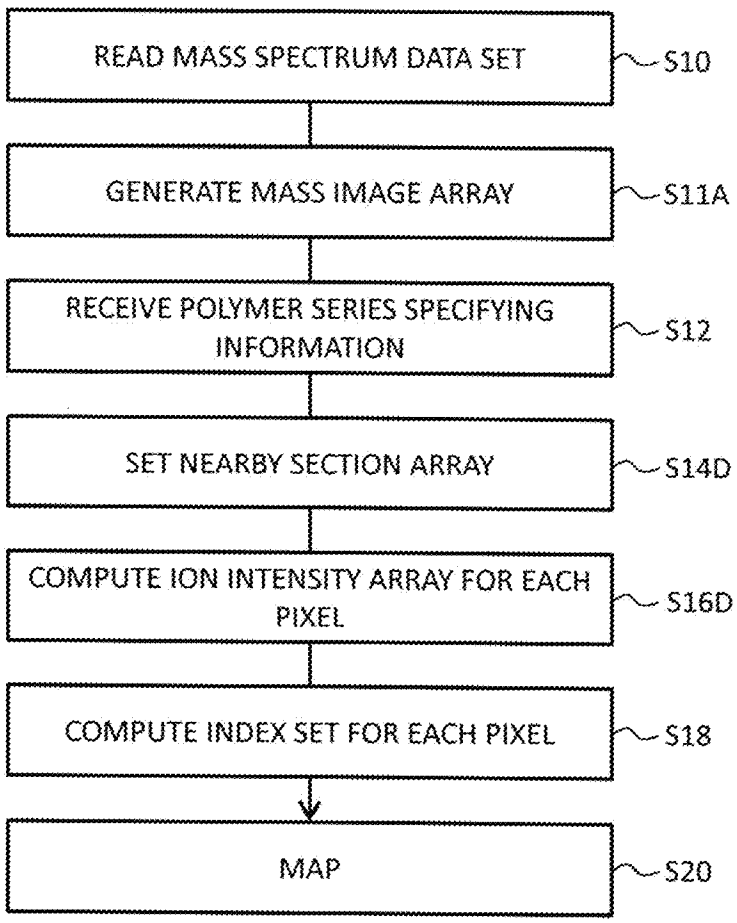
FIG. 18 is a diagram showing a fifth example of a method of processing a mass spectrum.
Figure 17:
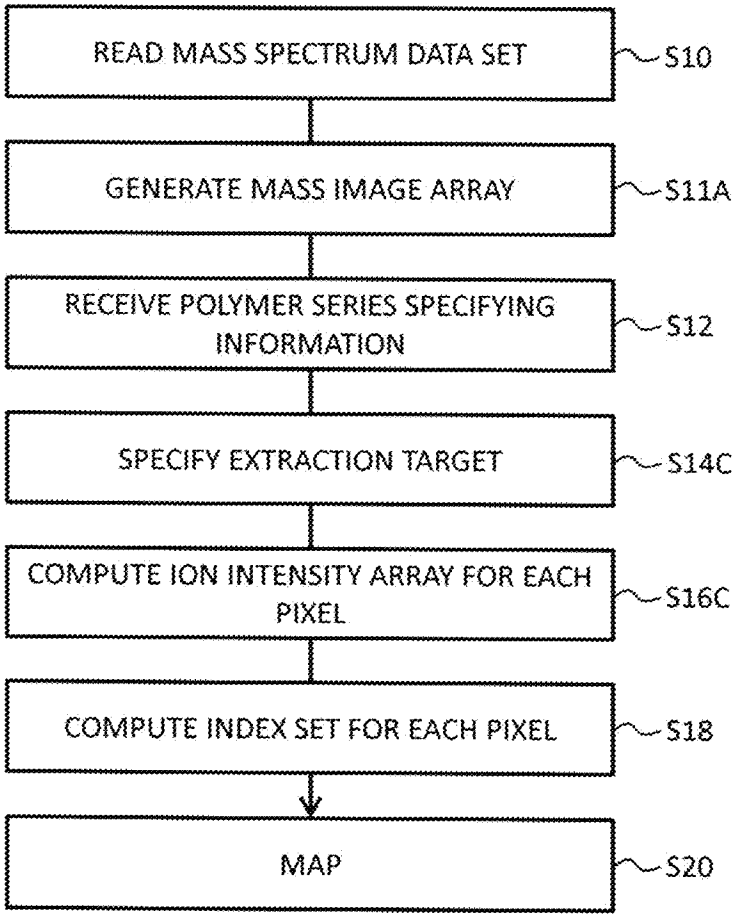
FIG. 17 is a diagram showing a fourth example of a method of processing a mass spectrum.
Figure 19:
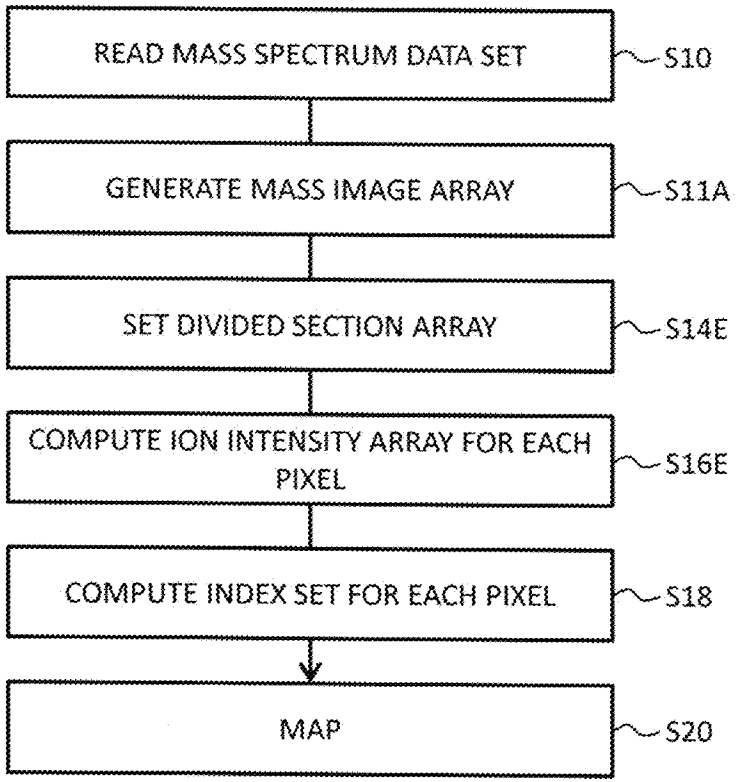
FIG. 19 is a diagram showing a sixth example of a method of processing a mass spectrum.

With reference to FIGS. 17~19, fourth through sixth examples of the method of processing the spectrum performed by the information processor apparatus will be described.

In the fourth example shown in FIG. 17, in S11A, a mass image array is generated based on the mass spectrum array. Based on the polymer series specifying information received in S12, a mass theoretical value array is specified. In S14C, a plurality of mass images to be extracted; that is, a plurality of mass images to be referred to in the computation of the ion intensity, are specified based on the mass theoretical value array. For example, a plurality of mass images corresponding to the plurality of mass theoretical values of the mass theoretical value array may be extracted. In S16C, a plurality of ion intensity arrays corresponding to the plurality of pixels are specified based on the plurality of mass images which are extracted, and a plurality of index sets corresponding to the plurality of pixels are computed based on the plurality of ion intensity arrays.

In the fifth example shown in FIG. 18, in S14D, a nearby section array is set on the mass axis based on the mass theoretical value array. An individual nearby section is a certain section centered at individual mass theoretical value. A plurality of mass images belonging to individual nearby section are extracted. In S16D, for each individual nearby section, an ion intensity is computed in units of pixels based on the plurality of mass images which are extracted.

In the sixth example shown in FIG. 19, in S14E, a divided section array on the mass axis is set for the mass image array. For each divided section, a plurality of mass images belonging thereto are extracted. In S16E, based on the plurality of mass images, the ion intensity is computed for each divided section and for each pixel. With this process, for the mass image array as a whole, a plurality of ion intensity arrays corresponding to the plurality of pixels are specified. A plurality of index sets are computed based on the plurality of ion intensity arrays.

As described, according to the first embodiment and the second embodiment of the present disclosure, an index distribution image reflecting the entirety of the plurality of mass spectra corresponding to the plurality of pixels can be provided for the user. Such an index distribution image is useful particularly in the analysis of polymers. By providing a plurality of types of the index distribution images to the user, it becomes easier to evaluate and analyze the polymers spatially and from many aspects.

The invention claimed is:

1. An apparatus for processing a mass spectrum, comprising:

an index computation unit that computes, based on a plurality of mass spectra corresponding to a plurality of pixels which form an observation region which is set for a sample, an index showing a characteristic of a mass spectrum as a whole in units of mass spectra; and a generator that generates an index distribution image corresponding to the observation region based on a plurality of indices corresponding to the plurality of pixels.

2. The apparatus for processing the mass spectrum according to claim 1, wherein the sample is a polymer.

3. The apparatus for processing the mass spectrum according to claim 1, wherein the index is a number average molecular weight, a weight average molecular weight, a polydispersity, a number average degree of polymerization, a weight average degree of polymerization, or a total ion amount.

4. The apparatus for processing the mass spectrum according to claim 1, wherein the index computation unit computes an index set formed from a plurality of indices and showing a plurality of characteristics of the mass spectrum as a whole in units of the mass spectra, and the generator generates a single index distribution image or a plurality of index distribution images based on a plurality of index sets corresponding to the plurality of pixels.

5. The apparatus for processing the mass spectrum according to claim 1, wherein the index computation unit:

computes a plurality of ion intensity arrays from the plurality of mass spectra; and computes the plurality of indices based on the plurality of ion intensity arrays.

6. The apparatus for processing the mass spectrum according to claim 5, wherein each of the ion intensity arrays is computed based on a plurality of portions which exist discretely on each of the mass spectra.

7. The apparatus for processing the mass spectrum according to claim 6, wherein the sample is a polymer, and the plurality of portions correspond to a plurality of degrees of polymerization of the polymer.

8. The apparatus for processing the mass spectrum according to claim 5, wherein each of the plurality of ion intensity arrays is computed based on a plurality of portions which exist on each of the mass spectra in an interconnected manner.

9. The apparatus for processing the mass spectrum according to claim 1, wherein a plurality of mass images are generated based on the plurality of mass spectra, and the index computation unit computes the plurality of indices corresponding to the plurality of pixels based on the plurality of mass images.

10. An apparatus for processing a mass spectrum, comprising:

a means for computing, based on a plurality of mass spectra corresponding to a plurality of pixels which form an observation region which is set for a sample, an index showing a characteristic of a mass spectrum as a whole in units of mass spectra; and a means for generating an index distribution image corresponding to the observation region based on a plurality of indices corresponding to the plurality of pixels.

11. A method for processing a mass spectrum, comprising:

computing, based on a plurality of mass spectra corresponding to a plurality of pixels which are set for a sample, an index set formed from a plurality of indices and showing a plurality of characteristics of a mass spectrum as a whole in units of mass spectra; and generating a plurality of index distribution images based on a plurality of index sets corresponding to the plurality of pixels.

* * * * *